US005653074A

United States Patent [19]

Yoon

[11] Patent Number: 5,653,074

[45] Date of Patent: Aug. 5, 1997

[54] DOORFRAME

[76] Inventor: Suk Kyu Yoon, 453, Osan-li, Baeksuk-myun, Yangju-kun, Kyungki-do, Rep. of Korea

[21] Appl. No.: 267,617

[22] Filed: Jun. 29, 1994

[30] Foreign Application Priority Data

Jun. 29, 1993 [KR] Rep. of Korea ..... 93-11589

[51] Int. Cl.[6] ..... E06B 1/06

[52] U.S. Cl. ..... 52/210; 52/204.1; 52/211; 52/656.4; 52/656.2; 49/504; 411/57

[58] Field of Search ..... 49/504; 52/210, 52/204.1, 204.2, 656.4, 656.5, 656.7, 656.9, 211, 212, 656.2, 656.6; 411/57

[56] References Cited

U.S. PATENT DOCUMENTS

| | | | |
|---|---|---|---|
| 470,995 | 3/1892 | Duchemin | 403/23 X |
| 2,910,739 | 11/1959 | Snitker | 49/504 |
| 3,200,447 | 8/1965 | Parker | 49/504 |
| 3,230,676 | 1/1966 | Dixon | 52/204.1 X |
| 3,363,371 | 1/1968 | Villalobos | 52/210 X |
| 3,574,378 | 4/1971 | Heywood | 52/656.9 X |
| 3,609,928 | 10/1971 | Mock | 52/210 |
| 3,769,773 | 11/1973 | Mochizuki | 52/211 X |
| 3,812,621 | 5/1974 | Ragland | 52/210 X |
| 3,941,028 | 3/1976 | Lobello et al. | 411/57 X |
| 3,975,875 | 8/1976 | Goss, Jr. | 52/288.1 X |
| 4,166,346 | 9/1979 | Barr | 49/504 X |
| 4,330,230 | 5/1982 | Giannuzzi | 411/57 X |
| 4,408,937 | 10/1983 | Hainke et al. | 411/57 X |
| 4,640,654 | 2/1987 | Fischer et al. | 411/57 X |
| 4,678,383 | 7/1987 | Bergner | 411/57 X |
| 5,261,203 | 11/1993 | Yoon | 52/656.4 X |

FOREIGN PATENT DOCUMENTS

| | | | |
|---|---|---|---|
| 2399528 | 4/1979 | France | 49/504 |
| 6-42265 | 2/1994 | Japan | 52/204.1 |
| 8002-518 | 12/1981 | Netherlands | 52/204.1 |
| 8005-886 | 5/1982 | Netherlands | 52/204.1 |
| 8103-163 | 2/1983 | Netherlands | 52/204.1 |
| 476195 | 9/1969 | Switzerland | 49/504 |

*Primary Examiner*—Carl D. Friedman
*Assistant Examiner*—Laura A. Saladino
*Attorney, Agent, or Firm*—Margaret B. Kelley; Rogers & Wells

[57] ABSTRACT

The present invention relates to a door frame made of wood. The door frame comprises a pair of rails, a pair of stiles and connectors. At each of the connecting ends of the rails and stiles, hollows and holes are formed, into which a connector capable of disassembly is inserted and fixed, thereby joining and tightening the rails and stiles. The door frame can maintain its integrity and still provide for convenient repair and replacement of damaged portions by disassembly of the connector.

12 Claims, 3 Drawing Sheets

DOORFRAME

BACKGROUND OF THE INVENTION

The present invention relates to a door frame made of wood, and, more particularly, to an improved door frame structure of connecting rails and stiles that is rigid and yet easy to manufacture.

Conventionally, a wooden door frame is formed by driving metal nails to connection portions of each rail and stile. Accordingly, there are drawbacks in that the disassembly of the manufactured door frame is almost impossible, and that the replacement and repair of damaged parts are also difficult. Further, nailing weak wooden material with metal nails causes cracks in the wooden material. Therefore, conventional connection between the members results in a warp and wind of the door frame after use over a long period of time.

SUMMARY OF THE INVENTION

To solve the above problem, it is an object of the present invention to provide a door frame in which assembly between rails and stiles can be performed and that tight mating between each of the members can be maintained.

Another object of the invention is to provide a door frame which has advantages, such as reduction in noise and protection against wind, by installing highly elastic artificial plastic wood at certain positions of the stiles facing the opening and closing portions of the door.

To accomplish the above objects, there is provided a door frame comprising:

a pair of rails including first connecting ends in which at least one first hollow or more is formed; a pair of stiles including second connecting ends associated at a right angle to the first connecting ends of the rails and composed of hole(s) to be aligned with the first hollow (s); and connecting means, inserted into each of the aligned hollow(s) and hole(s), for tightly connecting the ends of the pairs of rails and stiles together into the assembled door frame.

DETAILED DESCRIPTION OF THE PREFERRED EMBODIMENT

A preferred embodiment of the present invention will be described below in more detail with reference to the accompanying drawings.

Figure 1:
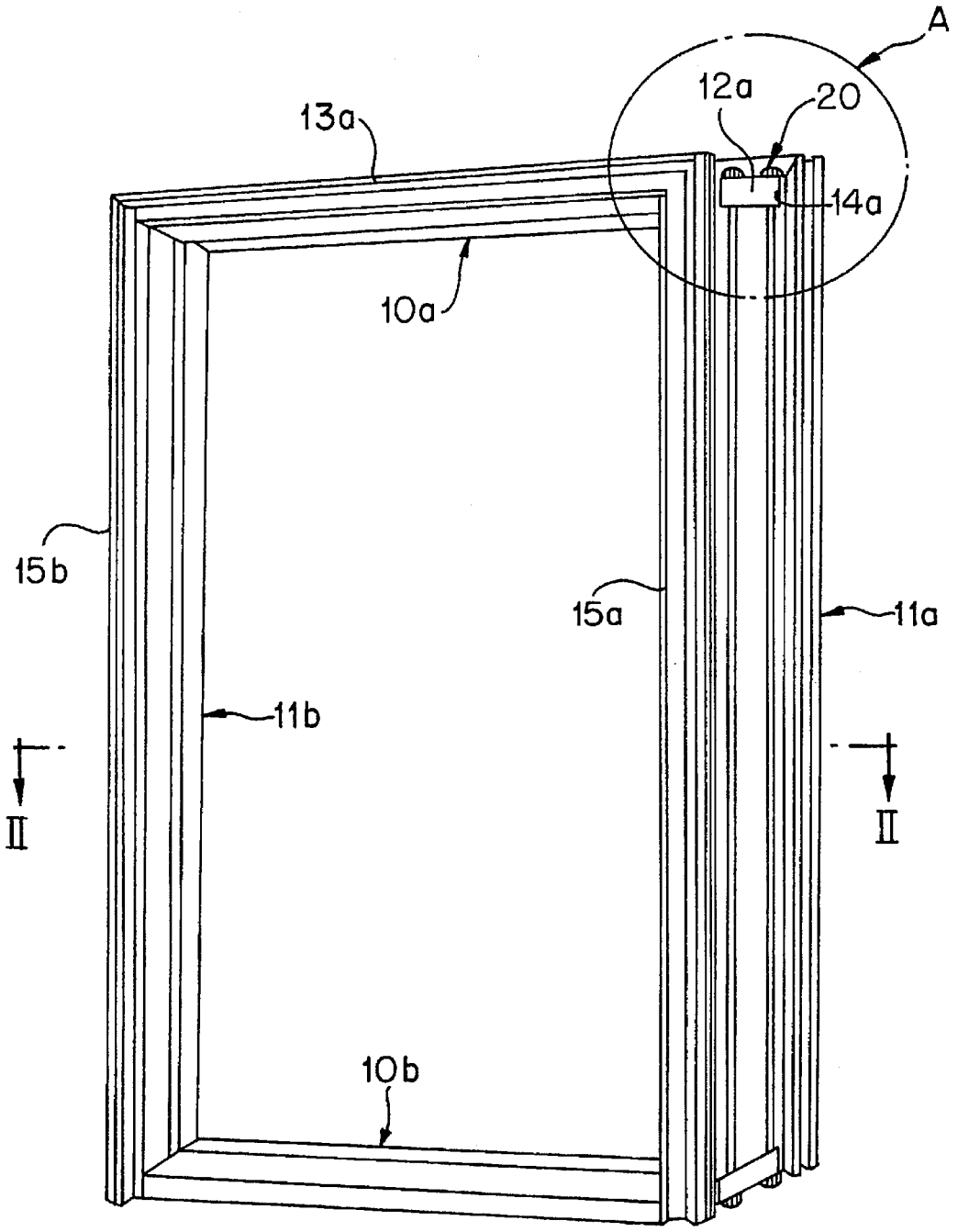
FIG. 1 is a perspective view of a door frame in accordance with the present invention.

FIG. 1 is a perspective view of a door frame in accordance with the present invention. The door frame of the invention comprises a pair of rails 10*a* and 10*b*, and a pair of stiles 11*a* and 11*b*. At sides of the first rail 10*a* and first and second stiles 11*a* and 11*b*, ornamental frames 13*a*, 15*a* and 15*b* are installed for a visually beautiful effect, respectively. The ornamental frames 13*a*, 15*a* and 15*b* are preferably made of a resin, an artificial plastic substance which allows improved shape variation and shock absorption. Since the structure of the rails 10*a* and 10*b* and the stiles 11*a* and 11*b* are the same, only one example of each of the two pairs will be described below. Mating ends 12*a* such as a male mating end having the prominence (⊓) shape are installed at both sides of the first rail 10*a*. Corresponding mating ends 14*a*, such as a female mating end having a depression (⊔) shape corresponding to the prominence shape of the combining ends 12*a* of the first rail 10*a* are installed at both sides of the first stile 11*a*. Each of mating ends 12*a* and 14*a* of the first rail 10*a* and first stile 11*a* is joined to each other and then is fixed with a pair of anchor bolt sets 20 as a connecting means, thereby producing a door frame of rectangular shape. The size of the door frame can be varied by varying the length of the rail 10*a* and stile 11*a*.

Figure 2:
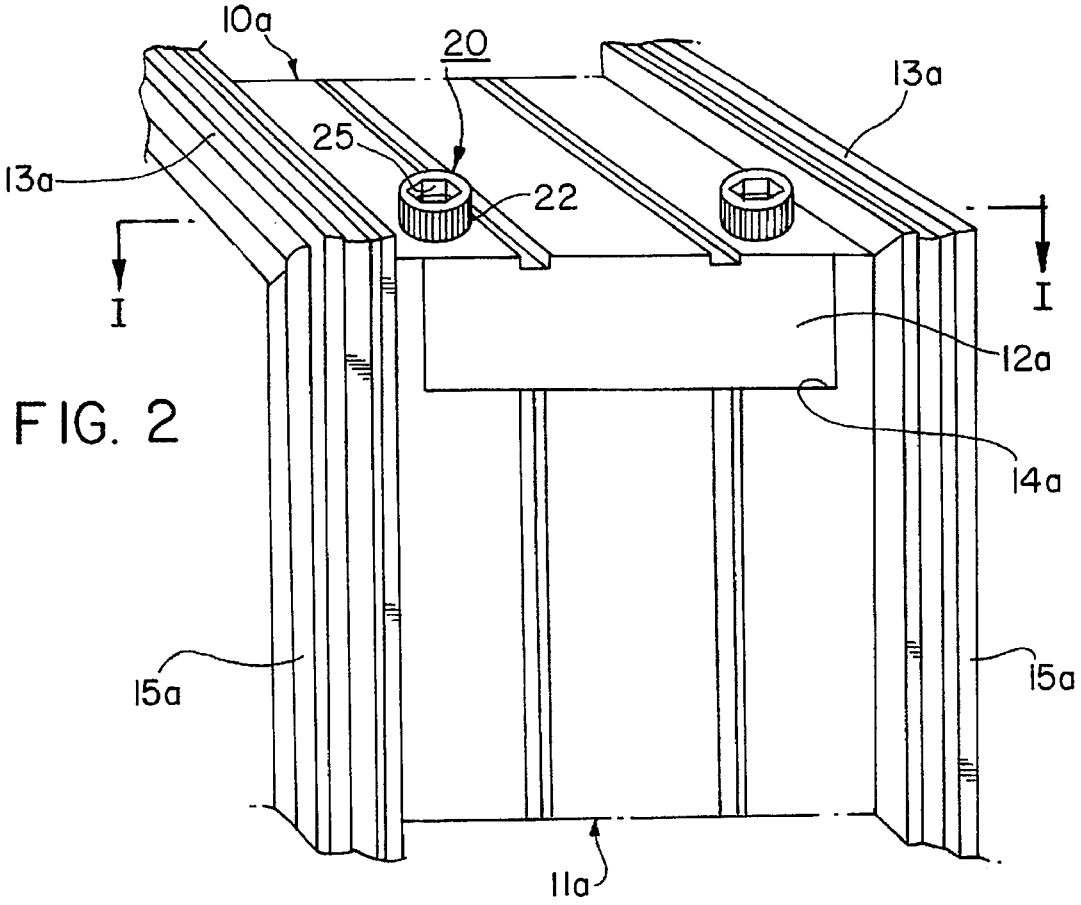
FIG. 2 is an enlarged perspective view of a part A in FIG. 1.

FIG. 2 is an enlarged perspective view of part A in FIG. 1, which shows that each of mating ends 12*a* and 14*a* of the first rail 10*a* and first stile 11*a* is closely tightened with a pair of anchor bolt sets 20. The anchor bolt sets 20 include a nut 22 having a hexagonal hole, the structural details of which are described in FIG. 4.

Figure 3:
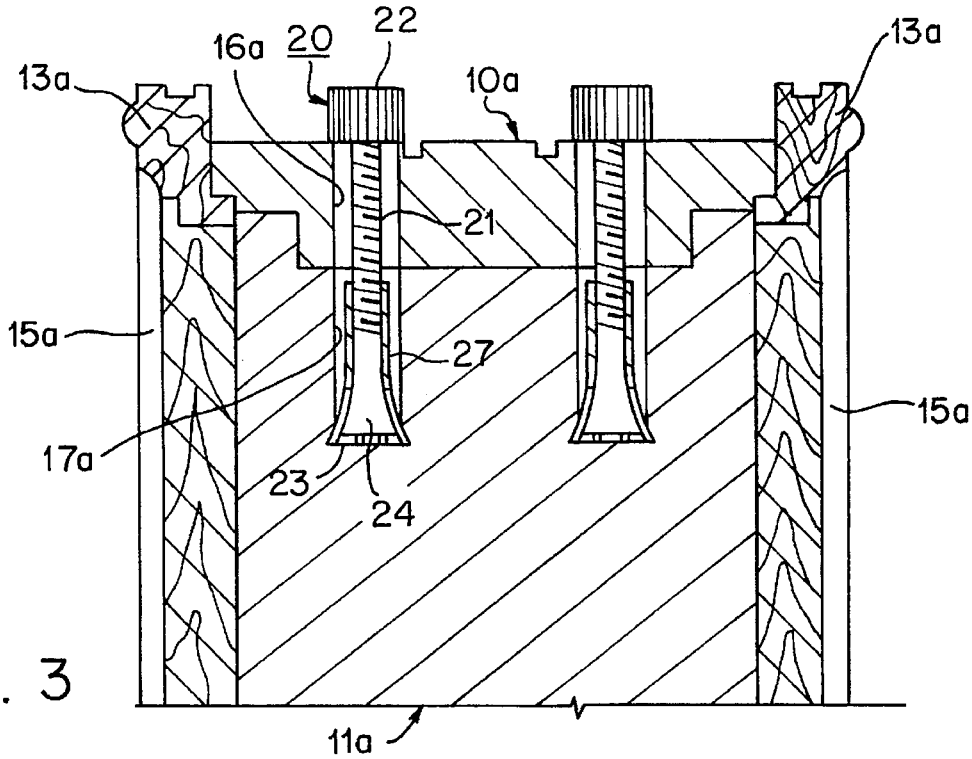
FIG. 3 is a longitudinal sectional view taken along line I—I of FIG. 2.

FIG. 3 is a longitudinal sectional view taken along line I—I of FIG. 2. At each of mating ends 12*a* and 14*a* of the first rail 10*a* and first stile 11*a*, hollows 16*a* and holes 17*a* are formed to be aligned with each other, respectively. The anchor bolt sets 20 are inserted and fixed into each of the aligned hollows 16*a* and holes 17*a*, thereby strongly tightening each of the combining ends of the first rail 10a and first stile 11*a* without any gaps occurring. The anchor bolt sets 20 include a nut 22 having a groove 25 into which a wrench can be inserted, a body 21 provided with a conically-shaped head 24, and a fixing tube 27 having several wings 23 which surround the conically-shaped head 24 and are connected to the body 21 with threads. Rotation of the body 21, based on rotation of the nut 22, makes the fixing tube 27 move into the conical shaped head 24 of the body 21. The moment the several wings 23 on the fixing tube 27 come into contact with the conically-shaped head 24, the several wings 23 are expanded radially outward by the pressure of the conically-shaped head 24, so as to be strongly fixed in the inner wall of the hole 17*a*. Then, the conically-shaped head 24 of the body 21 is joined in caught fashion to the wings 23 fixed in the inner wall. This joining causes each of the mating ends 12*a* and 14*a* of the first rail 10*a* and first stile 11*a* to be closely joined without any gaps occurring. A wide gap occurring between the rails and stiles is prevented by more firmly tightening the anchor bolt set 20, and thus the door frame is preserved from deformation preserving the door frame from deformation.

The disassembly is easily executed by a reverse sequence when repair or partial replacement of the door frame is required.

Figure 4:
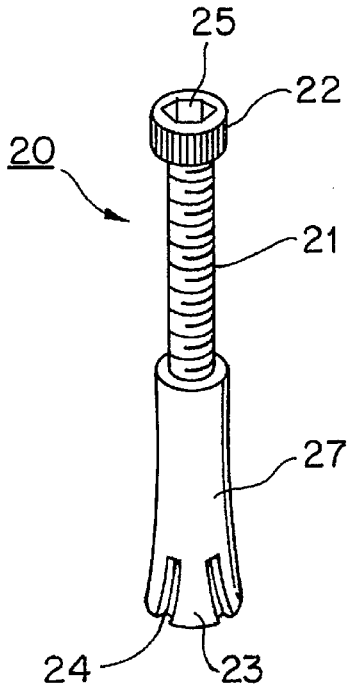
FIG. 4 is a perspective view of an anchor bolt set applied to a door frame in accordance with the present invention.

FIG. 4 is a perspective view of an anchor bolt set which is applied to the door frame in accordance with the present invention. Nut 22, a hex socket head, is disposed at the upper portion of the anchor bolt set 20, and at the lower portion the conically-shaped head 24 is formed. The fixing tube 27 having several wings 23 is connected to the body 21. The several wings 23 of the fixing tube 17 during connecting are expanded radically outward due to strong pressure from the conically-shaped head 24 of the body 21 and thereby the anchor bolt set 20 obtaining tight coherence.

Figure 5:
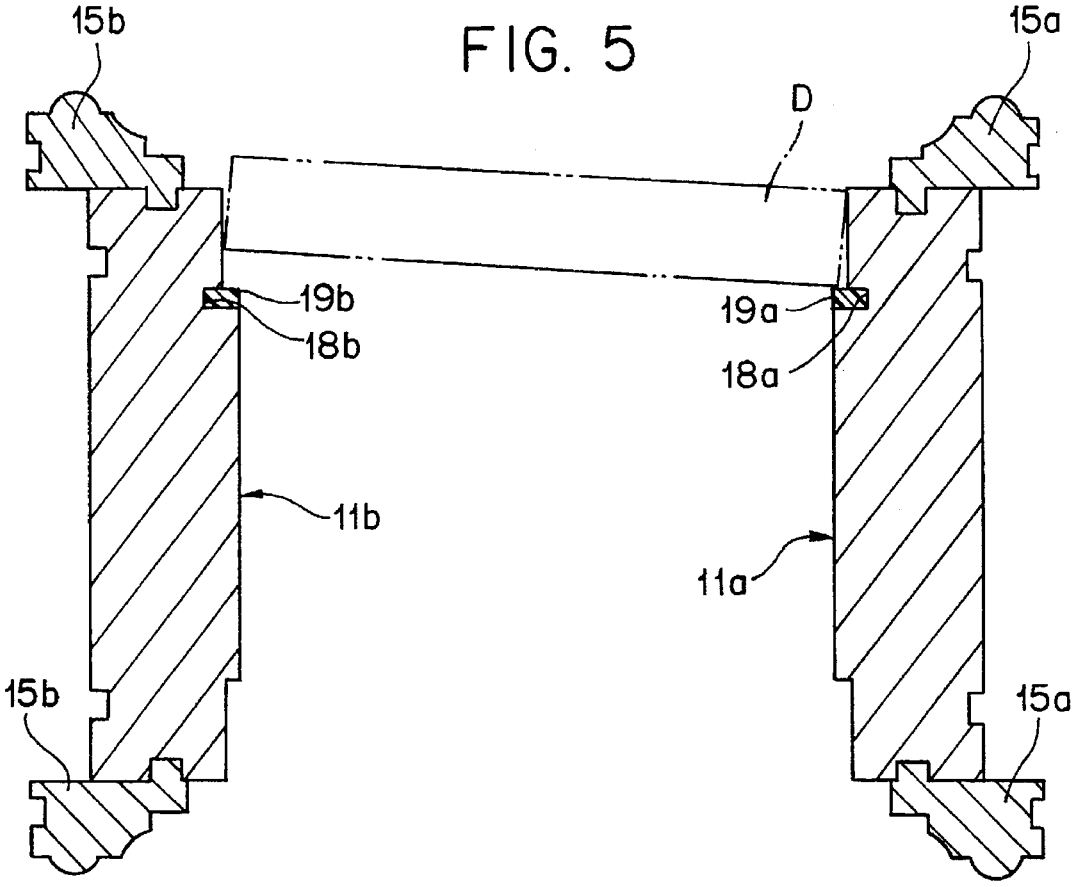
FIG. 5 is an enlarged cross-sectional view taken along line II—II of FIG. 1.

FIG. 5 is an enlarged cross-sectional view taken along line II—II of FIG. 1. Each of the stiles 11*a* and 11*b* longitudinally includes first and second border portions 19*a* and 19*b* which are formed to project outwardly with a stepped shape, which is made of an artificial plastic. The border portions 19*a* and 19*b* are rigidly inserted into first and second grooves 18*a* and 18*b* formed at the stiles 11*a* and 11*b*. Since the first and second border portions 19*a* and 19*b* are mainly made of a plastic such as polyurethane, having a high elasticity, this formation prevents noise during contact with a door D installed at the stiles 11*a* and 11*b*. Furthermore, this improves contact between the door D and border portions 19*a* and 19*b* which are highly elastic, thereby reducing the probability of a gap occurring and increasing the protection against wind.

As described above, the present invention, by connecting the rails and stiles with the anchor bolt sets, enables the door frame to be easily repaired and partially replaced. The present invention also provides a strong assembly without any gaps occurring between the connective portions of each of the members, as a result of high coherence of the anchor bolt sets 20, this allows the original state of the door frame to be maintained by just tightening the anchor bolt sets 20 when deformation of the door frame due to use over a long period of time happens. The invention also allows noise reduction and protection against wind by the installation of an elastic member at certain points in contact with the door.

What is claimed is:

1. A rectangular door frame made of wood, comprising:

a) a first rail having first and second connecting ends, wherein the first and second connecting ends of the first rail have at least one hollow therein;

b) a pair of identical stiles, each having a first connecting end connecting substantially perpendicularly to the first and second connecting ends of the first rail, and each having a second connecting end, wherein the first and the second connecting ends of each stile have at least one hole therein and wherein the hole(s) in the first ends of the pair of stiles are substantially aligned with each of the hollow(s) of the first rail;

c) a second rail identical to the first rail, having first and second connecting ends, wherein the first and second connecting ends of the second rail have at least one hollow therein aligning with and connecting substantially perpendicularly to the hole(s) in the second connecting ends of each stile; and d) an anchor bolt set connecting the hollows of the rails with the holes of the stiles consisting of a nut having a hex socket head and a threaded shaft and a fixing tube means detachably connected to the shaft, the fixing tube means having internal threads corresponding to the threads of the shaft, wherein the fixing tube has a plurality of wings formed at an end thereof.

2. The door frame of claim 1, wherein the hex socket head has a groove in the center for inserting a wrench.

3. The door frame of claim 1, wherein the stiles further comprise first and second border portions which project outwardly with a stepped shape.

4. The door frame as claimed in claim 3, wherein the border portions are made of an artificial plastic substance.

5. The door frame of claim 4, wherein the plastic substance has a high elasticity.

6. The door frame of claim 3, wherein the stiles have first and second grooves near the ends mating with the first and second border portions.

7. The door frame as claimed in claim 1, wherein the first and second connecting ends of the rails and the stiles have corresponding mating means connecting the rails and the stiles.

8. The door frame of claim 7, wherein the mating means are male and female mating means.

9. The door frame as claimed in claim 1, further comprising ornamental border frames installed at predetermined locations at the sides of the first rail and the first and second stiles.

10. The door frame of claim 9, wherein the ornamental border frames are made of an artificial plastic.

11. The door frame of claim 1, wherein the stiles have first and second grooves containing elastic border portions positioned for contact with a door.

12. The door frame of claim 11, wherein the elastic border portions are a polyurethane.

* * * * *